US007886834B2

(12) United States Patent
Spencer et al.

(10) Patent No.: US 7,886,834 B2
(45) Date of Patent: Feb. 15, 2011

(54) ANCHORING SYSTEM FOR USE IN A WELLBORE

(75) Inventors: Max E. Spencer, Houston, TX (US); Ruben Martinez, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/205,088

(22) Filed: Sep. 5, 2008

(65) Prior Publication Data

US 2009/0071659 A1 Mar. 19, 2009

Related U.S. Application Data

(60) Provisional application No. 60/973,214, filed on Sep. 18, 2007.

(51) Int. Cl.
*E21B 23/00* (2006.01)

(52) U.S. Cl. ..... 166/382; 166/217; 166/212; 166/216

(58) Field of Classification Search ..... 166/382, 166/217, 212, 216, 206
See application file for complete search history.

(56) References Cited

U.S. PATENT DOCUMENTS 4,941,532 A 7/1990 Hurt et al.
4,971,146 A 11/1990 Terrell
6,464,003 B2 10/2002 Bloom et al.
6,640,894 B2 11/2003 Bloom et al.
6,715,559 B2 4/2004 Bloom et al.
6,796,380 B2 9/2004 Xu
6,892,811 B2 5/2005 LaClare et al.
6,920,936 B2 * 7/2005 Sheiretov et al. ..... 166/382
7,048,047 B2 5/2006 Bloom et al.
7,278,482 B2 10/2007 Azar
7,334,642 B2 * 2/2008 Doering et al. ..... 166/382
2003/0173076 A1 9/2003 Sheiretov et al.
2006/0180318 A1 * 8/2006 Doering et al. ..... 166/384

* cited by examiner

*Primary Examiner*—Daniel P Stephenson
*Assistant Examiner*—Yong-Suk Ro
(74) *Attorney, Agent, or Firm*—Michael L. Flynn; David Hofman; Jody Lynn DeStefanis

(57) ABSTRACT

A technique enables anchoring of a tool in a wellbore. The technique utilizes one or more arms pivotably mounted to a structure for movement between a radially inward position and radially outward position that anchors the tool to a surrounding wall. A wedge component is positioned to selectively engage the arms. When relative axial movement is caused between the wedge component and the arms, the arms are pivoted to a desired radial position.

28 Claims, 4 Drawing Sheets

ANCHORING SYSTEM FOR USE IN A WELLBORE

CROSS-REFERENCE TO RELATED APPLICATION

The present document is based on and claims priority to U.S. Provisional Application Ser. No. 60/973,214, filed Sep. 18, 2007.

BACKGROUND

Many types of mechanical operations are performed in the course of maintaining and optimizing production from wells. Performing some of these operations requires application of axial forces to a device located downhole in a completion assembly. For example, isolation valves located in production tubing may be opened or closed by pushing or pulling an internal feature. In other examples, axial forces are used in the retrieval of a plug or a gas valve and in various fishing operations.

To facilitate the pushing or pulling operation, the downhole tool is anchored at a specific location in a wellbore with an anchoring device. For example, many completions use anchor slips that can support large forces. However, anchor slips have limited radial expansion with respect to the tool body. Other anchoring devices used dogs that extend from a tool body into a corresponding groove feature in a completion string. Such devices also can support large forces but require the use of special anchoring grooves at specific locations within the completion string.

In a variety of operations, wireline tools are employed and the wireline tools must be anchored within tubing at arbitrary locations. In many applications, anchoring of the wireline tool also requires significant radial expansion of the anchoring mechanisms. Attempts have been made to provide suitable anchoring mechanisms by incorporating pistons that can be moved radially outward from a tool body to engage an inner circumference of a well. Other systems have employed various linkages that expand against a surrounding tubular. However, existing designs have significant complexity or other drawbacks that limit their usefulness in specific types of applications.

SUMMARY

In general, the present invention provides a system and method for anchoring a tool in a wellbore. One or more arms can be mounted to a structure for pivotable movement between a radially inward position and radially outward position that anchors the tool to a surrounding wall. A wedge component is positioned to selectively engage the arm or arms. When relative axial movement is caused between the wedge component and the one or more arms, the arm/arms are pivoted to a desired radial position.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for anchoring a tool in a wellbore. The tool may be anchored within a tubular, such as a casing or an internal tubing, at any appropriate/desired location along the tubing. In some applications, the tool also may be anchored in an open wellbore. In other applications, the tool can be anchored inside another tool or device, e.g. a completion valve. The system and methodology are useful with a variety of well related tools, such as wireline tools. For example, the anchoring system can be used to firmly anchor a wireline tool in a wellbore such that the wireline tool is able to apply axial force required for performance of a given operation.

The anchoring system is designed to enable significant expansion and contraction of the anchoring tool. The significant radial change allows the anchoring tool to pass through restrictions in a tubing string, for example, while enabling anchoring in a larger section below the restriction. Additionally, the system enables anchoring in featureless tubing of a variety of diameters. However, even though the anchoring tool has a large opening ratio, the tool maintains a significantly high anchoring strength.

In general, the anchoring tool functions by extending one or more anchor arms away from a housing or body until the anchoring arm or arms establish contact with an anchoring surface. Each arm applies a radial force to the anchoring surface to produce substantial traction which anchors the tool in place. The anchoring surface may be the interior surface of a tubular structure, such as a production tubing, a casing, a pipeline, an open wellbore, or another structure. The inside surface often is cylindrical in shape, but it also can have more complex geometries, e.g. triangular, rectangular, or other shapes within downhole structures. As described in greater detail below, each anchoring arm is extended outwardly through cooperation with a wedge component comprising one or more wedge features that act against the arms when the anchoring tool is actuated. The wedge component further supports the arms while they are engaged with the anchoring surface when the tool is in an anchoring configuration. Each anchoring arm is deployed by causing relative movement between the anchoring arm and the wedge component in one direction; and each anchoring arm is closed or allowed to close by causing relative movement in another, e.g. opposite, direction.

Figure 1:
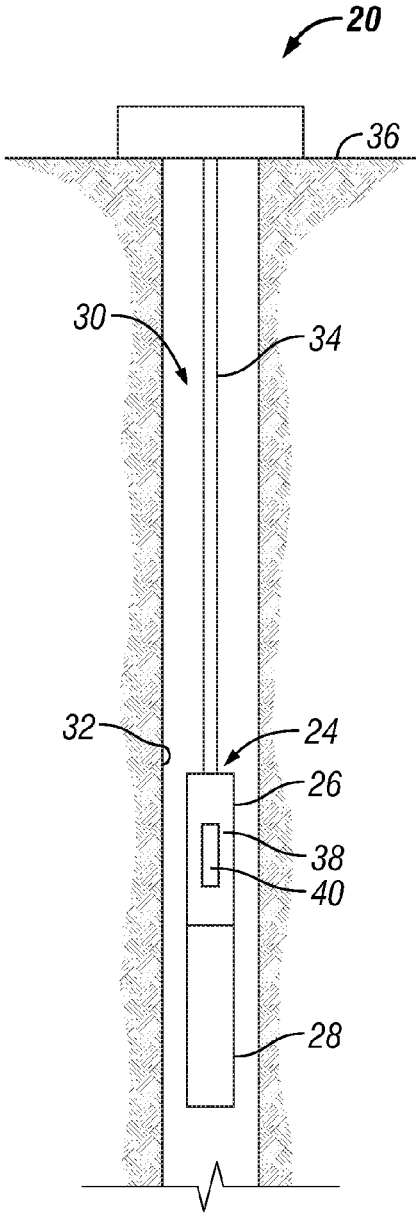
FIG. 1 is a schematic front elevation view of an anchoring system deployed in a wellbore, according to an embodiment of the present invention.

Referring generally to FIG. 1, one embodiment of a well system 20 is illustrated as having an anchoring system 24 comprising an anchoring tool 26. In this embodiment, anchoring tool 26 is connected to a well tool 28 which may have a variety of forms depending on the specific well application in which well tool 28 and anchoring tool 26 are utilized. For example, well tool 28 may comprise a wireline tool for performing a variety of downhole operations. Well tool 28 also may comprise a completion tool, a tool string, a treatment tool, or a variety of other tools deployed downhole to perform the desired operation.

In the embodiment illustrated, anchoring tool 26 and well tool 28 are deployed downhole into a wellbore 30 within a tubular 32, which may comprise a well completion assembly, casing, production tubing or other downhole structure. A conveyance 34, such as a wireline, is used to deploy the anchoring tool 26 and well tool 28 into wellbore 30 from a surface location 36. However, other types of conveyances, e.g. coiled tubing or jointed pipe, also can be used to deploy the anchoring tool and the well tool.

Figure 2:
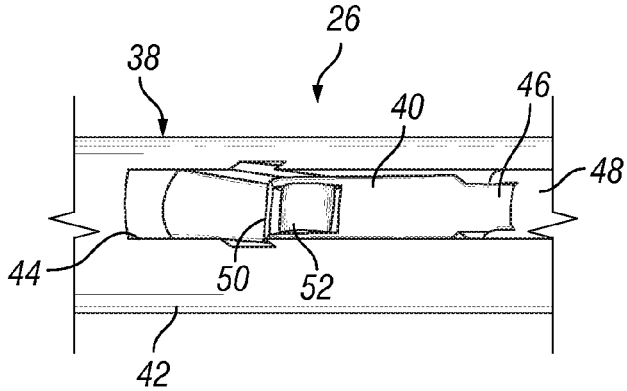
FIG. 2 is a partial view of an anchoring tool, according to an embodiment of the present invention.

The anchoring tool 26 comprises a structure 38 and one or more anchor arms 40 that move relative to structure 38 between a radially contracted configuration and a radially expanded, anchoring configuration. In FIG. 2, a portion of one embodiment of anchoring tool 26 is illustrated as having a plurality of arms 40 positioned in the radially contracted or closed position to allow movement of anchoring tool 26 down through tubular 32 and through potential restricted regions. In the example illustrated, structure 38 comprises a body 42 having openings or recesses 44 with each opening or recess 44 sized to receive a corresponding anchor arm 40. When the arms 40 are in a radially contracted/closed configuration, the arms are contained within the envelope of the tool body 42. Containment of the anchor arms 40 ensures the arms do not limit the ability of anchoring tool 26 to pass through restrictions and also prevents the arms from causing tool 26 to become caught or hung up on features during deployment or retrieval of the anchoring tool. By way of example, body 42 may comprise a cylindrical body. Although a plurality of arms 40 is illustrated, the anchoring tool 26 can be designed with a single anchoring arm or multiple anchoring arms.

Figure 3:
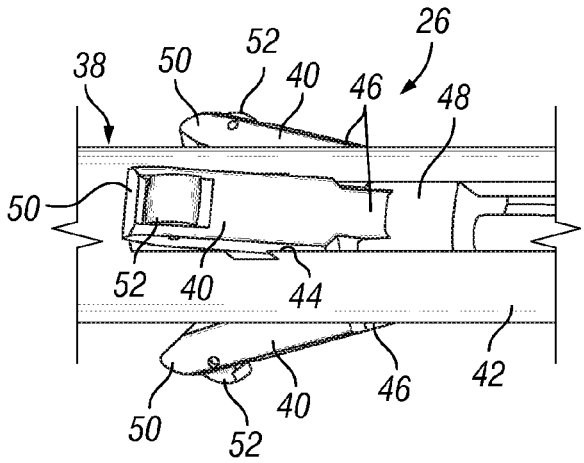
FIG. 3 is a view similar to that of FIG. 2 but showing the anchoring tool in a radially expanded configuration, according to an embodiment of the present invention.

Upon actuation of anchoring tool 26 to an anchoring configuration, the arms 40 are moved radially outward with respect to structure 38/body 42, as illustrated in FIG. 3. In the example illustrated, the arms 40 are pivoted to the radially outward, anchoring configuration. The arms 40 each comprise a pivot end 46 that may be pivotably mounted via a pivot pin 47 to a pivot base 48. As arms 40 pivot, an engagement end 50 is moved between the contracted configuration (FIG. 2) and an expanded, anchoring configuration (FIG. 3). At engagement ends 50, the anchoring arms 40 may further comprise traction features 52, such as articulating cams, to facilitate engagement with the surrounding wall, e.g. the inside surface of tubular 32. However, the traction features 52 can be integrally formed with corresponding arms 40. In the particular example illustrated, the anchoring tool 26 comprises three anchoring arms 40, however other numbers of anchoring arms, including a single anchoring arm, can be used in alternate embodiments. Additionally, the traction feature 52 can be mounted on a single arm 40 or on a plurality of the arms.

Figure 4:
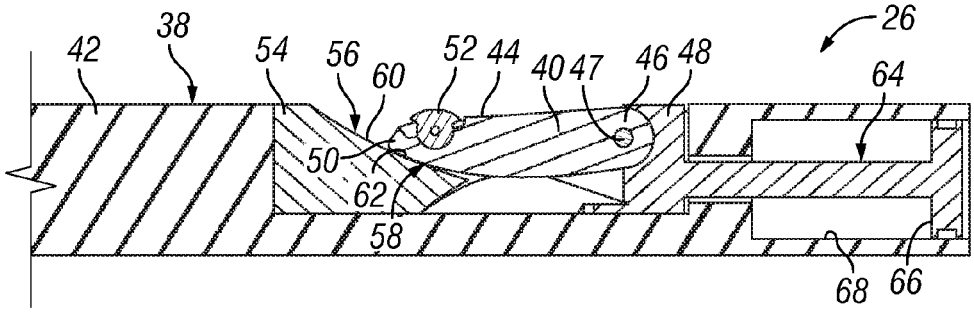
FIG. 4 is a cross-sectional view of one example of an anchoring tool, according to an embodiment of the present invention.
Figure 5:
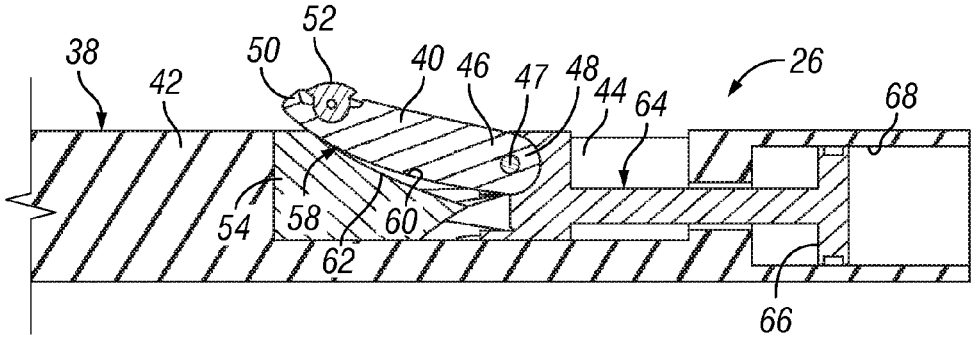
FIG. 5 is a view similar to that of FIG. 4 but showing the anchoring tool in an expanded configuration, according to an embodiment of the present invention.

Referring generally to the axial cross-sectional views of FIGS. 4 and 5, one example of anchoring tool 26 is illustrated in greater detail. As illustrated, a wedge component 54 is mounted in structure 38 and oriented to interact with the anchor arms 40. The wedge component 54 comprises a plurality of wedge features 56 disposed to interact with corresponding features 58 of each arm 40. For example, the corresponding features 58 may comprise radially inward surfaces along arms 40, the radially inward surfaces being located to engage the wedge features 56 during relative movement of wedge component 54 and the arms 40. One or both of the wedge component 54 and the arms 40 can be axially movable to cause the interaction and resultant radial movement of arms 40.

In the specific example illustrated, the plurality of arms 40 is axially movable relative to wedge component 54 by virtue of forming pivot base 48 as a movable pivot base. The actuation of anchoring tool 26 to the radially outward, anchoring configuration is caused by moving pivot base 48 in an axial direction toward wedge component 54. The axial movement causes wedge features 56 to engage corresponding features 58 and force each arm 40 to pivot in a radially outward direction, as illustrated in FIG. 5. Continued movement of pivot base 48 and arms 40 toward wedge component 54 causes continued radially outward movement of the plurality of arms 40 until the arms 40 engage the surrounding wall, e.g. tubular 32, to anchor well tool 28. Relative axial movement of the wedge component 54 away from arms 40 causes, or at least allows, the arms 40 to pivot radially inward to the contracted configuration, as illustrated in FIG. 4.

The wedge features 56 and the corresponding features 58 can be designed according to a variety of styles and configurations. In one embodiment, the interface between wedge features 56 and corresponding features 58 is designed to distribute the contact force over a larger area and thus minimize the contact stresses. Reduction of contact stresses enables an increase in the load capacity of the anchoring system. The distribution of contact forces is achieved by utilizing a curved surface interface between wedge features 56 and corresponding features 58. For example, each wedge feature 56 may comprise a curved surface 60, and each corresponding feature 58 may comprise a radially inward curved surface 62 on each arm 40. The curved surfaces 60 are shaped such that at their point of contact the surfaces 60 are tangent with the curved surfaces 62 of arms 40. The curved surfaces 62 have a greater curvature than the curved surfaces 60 of the wedge component 54.

Relative axial movement of the wedge component 54 and the arms 40 can be achieved by a variety of mechanisms. One or more actuators can be coupled to the arms 40 and/or the wedge component 54 to induce the desired, relative axial movement. In the embodiment illustrated in FIGS. 4 and 5, an actuator 64 is connected to pivot base 48 to move the arms 40 with respect to wedge component 54. The actuator 64 may comprise a hydraulic actuator, an electro-mechanical actuator, or other suitable actuators. By way of example, the actuator 64 may comprise a hydraulic piston 66 movably mounted within a piston chamber 68 for selected movement under the influence of hydraulic pressure. However, other implementations of actuator 64 may comprise a mechanical linear actuator, such as a power screw or other type of screw-based actuator. In other applications, the actuator 64 may comprise an explosive charge, a spring, a gas charge, or any combination thereof. In still other applications, the actuator 64 may comprise a slip joint disposed in structure 38 in a manner that enables selective relative movement of the plurality of arms 40 and the wedge component 54 when the structure 38 is axially compressed. These and other embodiments of actuator 64 can be used to cause the relative axial motion for transitioning anchoring tool 26 between contracted configurations and expanded, anchoring configurations.

Figure 6:
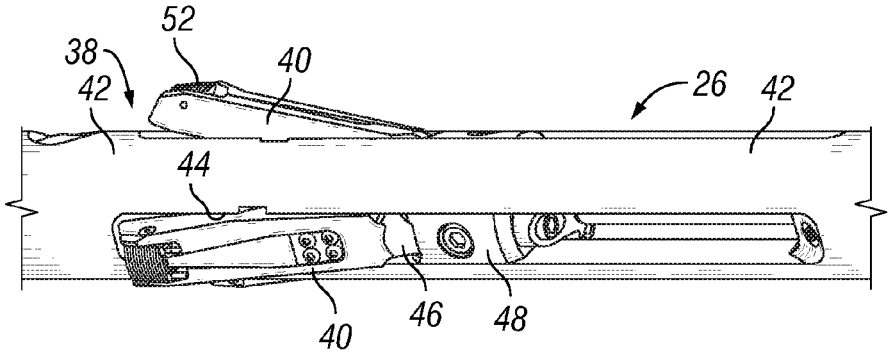
FIG. 6 is an orthogonal view of the anchoring tool with a plurality of arms extended radially from an anchoring tool body, according to an embodiment of the present invention.
Figure 7:
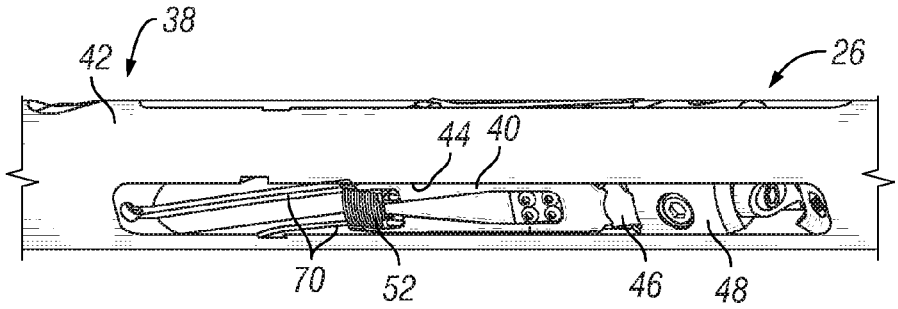
FIG. 7 is a view similar to that of FIG. 6 but showing the plurality of arms in a radially contracted position in which the arms are disposed in a recess within the anchoring tool body, according to an embodiment of the present invention.

In FIGS. 6 and 7, orthogonal views are provided of one embodiment of anchoring tool 26 to further illustrate the operation of actuator 64. In this embodiment, the motion of arms 40 is guided by a pin and slot system 70 (see FIG. 7) that ensures the arms 40 remain close to the wedge component 54. Also, the pin and slot system 70 can be designed to maintain arms 40 in recessed regions 44 of body 42 when the anchoring tool 26 is in a closed or contracted configuration. The pin and slot system 70 prevents uncontrolled radial movement of the anchoring arms 40.

When actuator 64 is moved in a first axial direction, pivot base 48 is forced toward wedge component 54 which, in turn, forces the plurality of arms 44 to a radially outward position, as illustrated in FIG. 6. However, when the actuator 64 is operated in an opposite direction, pivot base 48 and arms 40 are moved in an axial direction away from wedge component 54. As the movement away from wedge component 54 is continued, the arms 40 are allowed to radially contract into recessed areas 44, as illustrated best in FIG. 7. In this embodiment, the arms 40 and actuator 64 move as a unit relative to tool body 42. Consequently, if the anchoring tool fails in a manner that prevents it from retracting arms 40, the arms can be closed automatically if they encounter a restriction or other obstruction while pulling the anchoring tool 26 out of wellbore 30. When the arms encounter an obstruction after failure of the anchoring tool actuator, movement of the arms 40/actuator 64 is stopped while the rest of the anchoring tool continues to move during withdrawal. The induced relative motion effectively pushes the anchor arms 40 back into recesses 44, via pin and slot system 70, to transition the anchoring tool 26 to the radially contracted configuration.

Figure 8:
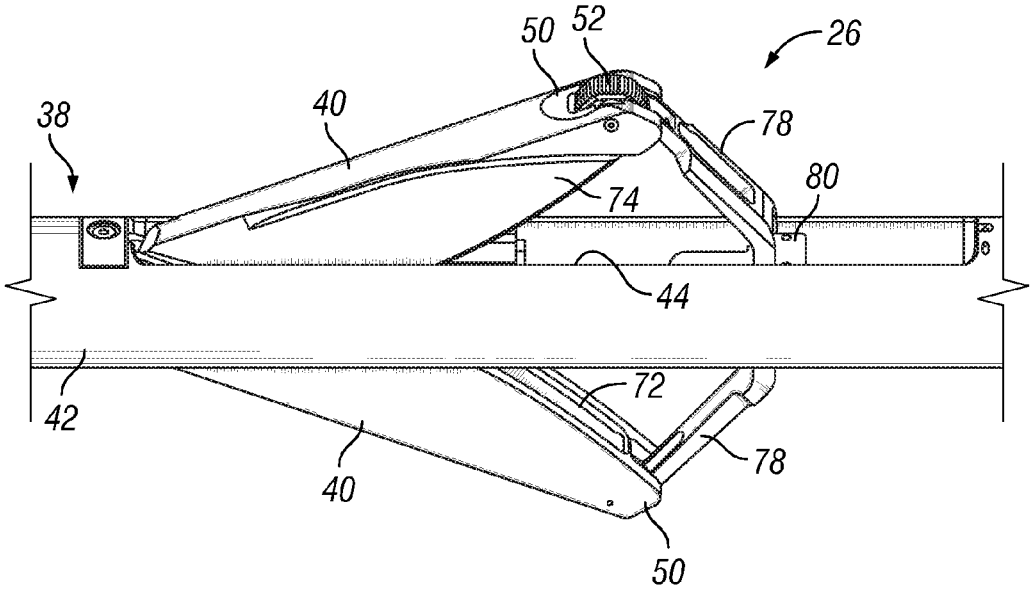
FIG. 8 is an orthogonal view of another example of an anchoring tool, according to an alternate embodiment of the present invention.
Figure 9:
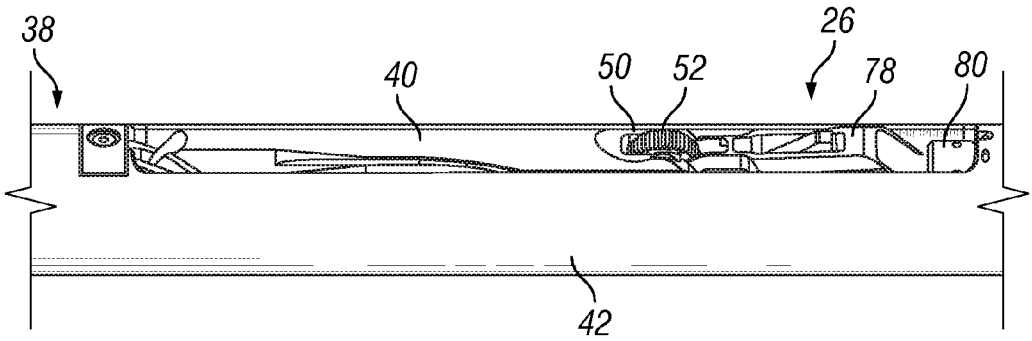
FIG. 9 is a view similar to that of FIG. 8 but showing the anchoring tool in a radially contracted configuration, according to an embodiment of the present invention.

Another embodiment of anchoring tool 26 is illustrated in FIGS. 8 and 9. In this embodiment, the plurality of anchoring arms 40 is pivotably mounted to structure 38 at a fixed location, and wedge component 54 is moved relative to the arms 40. By way of example, a pair of arms 40 may be pinned to body 42 for pivotable motion with respect to body 42. As the wedge component 54 is moved, the anchoring arms 40 can be transitioned between a radially expanded, anchoring configuration, as illustrated in FIG. 8, and a radially contracted configuration, as illustrated in FIG. 9.

By utilizing the two-armed design illustrated in FIGS. 8 and 9, a large opening ratio can be achieved. The two-armed design allows the anchoring arms 40 to have a taller configuration spanning a substantial or complete diameter of the anchoring tool body 42. The taller configuration is achieved by forming the arms 40 as nested arms. For example a first arm 40 may comprise a "U-shaped" cross-section 72 sized to allow a body section 74 of the opposing arm 40 to fit within the gap of the U-shaped cross-section 72. However, the anchoring arms 40 also can be designed with a variety of other nesting configurations, including scissor-like configurations.

Figure 10:
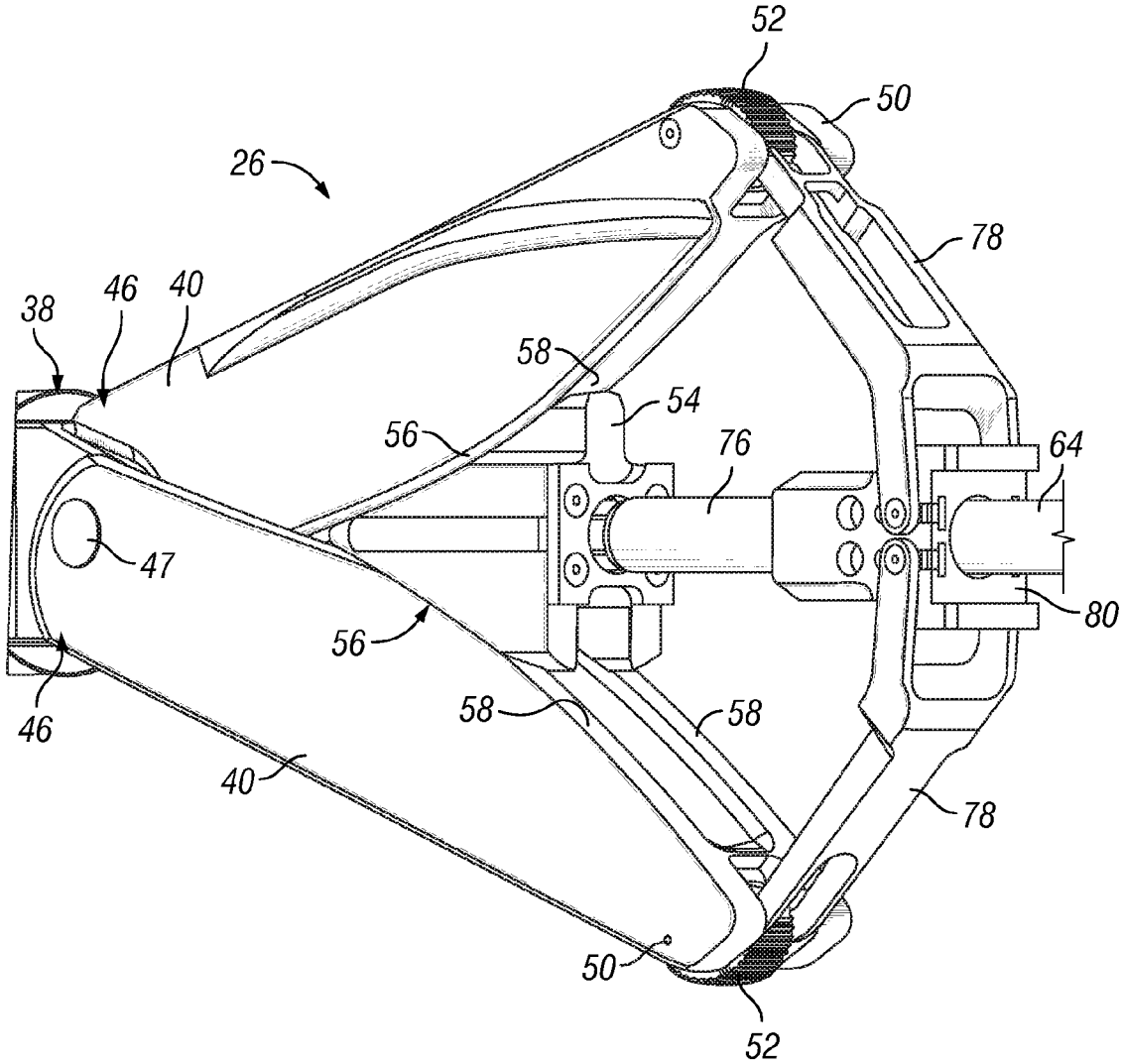
FIG. 10 is an orthogonal view of a portion of the anchoring tool illustrated in FIG. 8, according to an embodiment of the present invention.

As further illustrated in FIG. 10, the wedge component is driven in an axial direction with respect to anchoring arms 40 via a push rod 76 forming part of actuator 64. In a manner similar to that described above with respect to the embodiment illustrated in FIGS. 4 and 5, the wedge 54 comprises wedge features 56 that interact with corresponding features 58 of anchoring arms 40. Moving wedge component 54 in an axial direction toward the plurality of arms 40 causes interaction between wedge features 56 and corresponding features 58 which, in turn, forces the arms 40 to pivot in a radially outward direction. It should be noted that wedge features 56 and corresponding features 58 may comprise curved surfaces to create a curved surface interface for distributing the force load, as described above.

Withdrawal of wedge component 54 in an opposite axial direction allows arms 40 to pivot back to the radially inward, contracted configuration illustrated in FIG. 9. In some embodiments, linkages 78 are pivotably mounted between arms 40 and a hub 80 slidably disposed over push rod 76. When wedge component 54 is withdrawn, the wedge component or other features affixed to push rod 76 engage hub 80 and pull linkages 78. The movement of linkages 78 forces the anchoring arms 40 to pivot inwardly to the closed or contracted configuration.

Anchoring system 24 can be used in a variety of well systems and in a variety of well applications and environments. The anchoring tool can be constructed with two anchoring arms, three anchoring arms or a greater number of anchoring arms depending on the parameters of a given application. Additionally, the anchoring tool 26 can be incorporated into or used in cooperation with many types of well tools 28 that are deployed via wireline or other suitable conveyances. The size and configuration of the anchoring tool structure and the anchoring arms can be adjusted according to the size of the tubular in which it is used and according to other factors associated with a given environment or application. Furthermore, the one or more anchoring arms can be actuated via a variety of actuators and/or actuation techniques, including hydraulic techniques, electrical techniques, electro-mechanical techniques, explosive charge techniques, gas charge techniques, springs, and other suitable approaches to actuation.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for anchoring in a wellbore, comprising:

a body;

an arm pivotably mounted with respect to the body;

a wedge component positioned for interaction with the arm such that selected relative motion between the wedge component and the arm causes the arm to pivot radially outward to an anchoring position where extending portions of the arm extend radially from the wedge component while supporting portions of the arm are supportable by the wedge component; and an actuator to cause the relative motion, wherein the arm comprises a curved surface and the wedge component comprises a similarly curved surfaces such that interactions between the curved surfaces define an interface for distributing a contact force between the longitudinally curved surfaces.

2. The system as recited in claim 1, wherein the arm comprises a plurality of arms.

3. The system as recited in claim 2, wherein each arm of the plurality of arms comprises a traction component positioned to engage a surrounding wall when the plurality of arms is transitioned to the anchoring position.

4. The system as recited in claim 2, wherein the wedge component comprises a plurality of curved wedge surfaces oriented to engage corresponding curved surfaces on the plurality of arms.

5. The system as recited in claim 4, wherein the corresponding curved surfaces have a smaller curvature than the curved wedge surfaces.

6. The system as recited in claim 2, wherein the actuator is connected to a pivot base to which the plurality of arms is pivotably mounted.

7. The system as recited in claim 1, wherein the arm comprises at least three arms.

8. The system as recited in claim 1, wherein the actuator comprises a hydraulic piston.

9. The system as recited in claim 1, wherein the actuator comprises at least one of an electro-mechanical actuator, an explosive charge, a gas charge, and a spring.

10. The system as recited in claim 1, wherein a radius of curvature of the arm is less than a radius of curvature of the wedge component such that deflections of the arm caused by interactions between the anchoring surface and the arm result in the large area of contact between the supporting portions of the arm and the wedge component.

11. The system as recited in claim 1, wherein the interface minimizes contact stresses between the curved surfaces.

12. A method for anchoring in a wellbore, comprising:

mounting at least one arm to a structure for pivotable movement between a radially inward position and a radially outward anchoring position;

positioning a wedge component to selectively engage the at least one arm via a corresponding wedge feature; and causing relative axial movement between the wedge component and the at least one arm such that the wedge feature forces the at least one arm to pivot toward the radially outward anchoring position, wherein the at least one arm and the wedge feature are in sliding engagement as the arm is moved from its radially inward position to its radially outward anchoring position, wherein extending portions of the arm extend radially from the wedge feature while supporting portions of the arm are supportable by the wedge component and wherein cooperating surfaces of the arm and the wedge feature have similar radii of curvature such that deflections of the arm caused by interactions of the arm with an anchoring surface define an extended longitudinally curved interface for distributing a contact force between the arm and the wedge feature.

13. The method as recited in claim 12, wherein mounting comprises mounting a pair of arms that nest together when in the radially inward position.

14. The method as recited in claim 12, wherein mounting comprises mounting at least three arms that are recessed in a body when in the radially inward position.

15. The method as recited in claim 12, wherein positioning comprises orienting the corresponding wedge feature, having a curved wedge surface, to engage a radially inward surface of the at least one arm.

16. The method as recited in claim 12, further comprising guiding movement of the at least one arm via a pin and slot system.

17. The method as recited in claim 12, wherein causing relative axial movement comprises moving the at least one arm with an actuator.

18. The method as recited in claim 12, further comprising moving the body downhole in a wellbore; and anchoring a tool in the wellbore when the at least one arm engages a surrounding wall as the at least one arm is pivoted to the radially outward anchoring position.

19. The method as recited in claim 12, further comprising anchoring a wireline tool in a wellbore by causing the relative axial movement.

20. The method as recited in claim 12, wherein the interface minimizes contact stresses between the cooperating surfaces.

21. A device, comprising:

an anchoring tool for anchoring within a tubular, the anchoring tool comprising: a wedge component having engagement features; and a plurality of arms, each arm being pivotably mounted in the anchoring tool and having a traction feature oriented to engage the tubular when the anchoring tool is actuated, wherein relative movement between the wedge component and the plurality of arms causes the plurality of arms to pivot to different radial positions, wherein portions of the arm not extending beyond an outer surface of the body are supportable by engagement features of the wedge component, wherein the plurality of arms comprises contact surfaces oriented to act against the engagement features along an extended longitudinally curved interface between the contact surfaces and the engagement features when the anchoring tool is actuated to an anchoring position.

22. The device as recited in claim 21, further comprising an actuator coupled to one of the wedge component and the plurality of arms to cause the relative movement.

23. The device of claim 21, wherein the tubular is a wellbore.

24. The device as recited in claim 21, wherein the interface minimizes contact stresses between the contact surfaces.

25. A method of anchoring a tool in a wellbore, comprising:

deploying a downhole tool and an anchoring tool into a wellbore to a desired location;

actuating the anchoring tool by causing relative axial sliding movement between a wedge and a plurality of pivotable arms until the plurality of pivotable arms is pivoted against a surrounding surface to anchor the downhole tool; and distributing the contact force between the wedge and the plurality of pivotable arms during actuation of the anchoring tool by providing an extended interface between corresponding longitudinally curved surfaces.

26. The method as recited in claim 25, further comprising releasing the anchoring tool from the surrounding surface by causing relative axial movement of the wedge and the plurality of pivotable arms in an opposite direction.

27. The method as recited in claim 25, further comprising holding the plurality of pivotable arms in an anchoring tool body during deployment of the downhole tool.

28. The method as recited in claim 25, wherein distributing further comprises minimizing contact stresses between the curved surfaces.

* * * * *